US006129890A

United States Patent [19]

Lunk et al.

[11] Patent Number: 6,129,890

[45] Date of Patent: Oct. 10, 2000

[54] METHOD OF MAKING NON-SAG TUNGSTEN WIRE

[75] Inventors: Hans-Joachim Lunk, Towanda; Henry J. Stevens, Athens; Thomas J. Patrician, Monroeton; Harry D. Martin, III, Troy, all of Pa.

[73] Assignee: Osram Sylvania Inc., Danvers, Mass.

[21] Appl. No.: 09/391,121

[22] Filed: Sep. 7, 1999

[51] Int. Cl.[7] ..... B22F 1/00

[52] U.S. Cl. ..... 419/4; 419/28; 419/34; 419/35; 419/38

[58] Field of Search ..... 419/4, 34, 38, 419/35, 28

[56] References Cited

U.S. PATENT DOCUMENTS

| | | | |
|---|---|---|---|
| 1,082,933 | 12/1913 | Coolidge . | |
| 1,226,470 | 5/1917 | Coolidge . | |
| 1,410,499 | 3/1922 | Pacz . | |
| 3,853,492 | 12/1974 | Millner et al. | 29/182 |
| 3,927,989 | 12/1975 | Koo | 29/182.5 |
| 4,971,757 | 11/1990 | Day et al. | 419/23 |
| 5,019,330 | 5/1991 | Bewlay et al. | 419/39 |
| 5,072,147 | 12/1991 | Pugh et al. | 313/341 |
| 5,087,299 | 2/1992 | Fukuchi et al. | 148/11.5 |
| 5,284,614 | 2/1994 | Chen et al. | 419/20 |
| 5,785,731 | 7/1998 | Fait et al. | 75/368 |
| 5,795,366 | 8/1998 | Salmen et al. | 75/368 |

OTHER PUBLICATIONS

K. Hara et al., The Development of High Quality Tungsten Wire for High Stress Halogen Lamp, Nippon Tungsten Review 29 (1997) pp. 20–29.

H.–J. Lunk et al., What is behind "Tungsten Blue Oxides"?, Refractory Metals & Hard Materials 12 (1993–1994) pp. 17–26.

H.–J. Lunk et al., Solid State 1H NMR Studies of Different Tungsten Blue Oxides and Related Substances, Refractory Metals & Hard Materials 16 (1198) pp. 3–30.

*Primary Examiner*—Daniel J. Jenkins
*Attorney, Agent, or Firm*—Robert F. Clark

[57] ABSTRACT

It has been discovered that potassium retention in NS tungsten processing may be improved by double doping tungsten blue oxide (TBO) prior to reduction. The novel 'double-doping' process consists of dry doping standard singly doped K—Al—Si TBO with potassium nitrate, $KNO_3$, followed by the standard reduction, acid washing, sintering, rolling and drawing steps. In another aspect, the novel method includes an aqueous extraction of heteropoly-tungstate anion $[SiW_{11}O_{39}]^{8-}$ from a sample of the singly doped tungsten blue oxide to predict potassium retention.

10 Claims, 2 Drawing Sheets

METHOD OF MAKING NON-SAG TUNGSTEN WIRE

CROSS REFERENCE TO RELATED APPLICATIONS

This application is related to commonly assigned application Ser. No. 09/390,201, filed Sep. 7, 1999.

TECHNICAL FIELD

This invention relates to non-sag tungsten wire for use as filaments in electric lamps. In another aspect, this invention relates to methods of making potassium-doped tungsten powder for non-sag tungsten wire.

BACKGROUND ART

The metallurgy of tungsten plays a central role in the development of lamp filaments. Tungsten wire is made in various stages in accordance with the well-known Coolidge method, U.S. Pat. Nos. 1,082,933 (1913) and 1,226,470 (1917). Tungsten wire, which is used in the filaments of incandescent lamps, is subject to high mechanical loading and stresses, especially when it is used in lamps in which the filament operates at a temperature around 3000° C.

Pure tungsten wire is not suitable to make filaments for incandescent lamps. Under typical operating conditions, the individual grains of the filament have the tendency to offset, or slide off (creep or sag) with respect to each other. This causes the filament to sag and short out. A lamp made with such filaments will, therefore, fail prematurely. The beneficial effects of doping to improve the creep resistance of tungsten wire were recognized as early as 1910, and doping was practiced henceforth. Systematic doping of tungsten oxide powder with potassium-containing chemicals was patented by Pacz in 1922, U.S. Pat. No. 1,410,499 (1922). Non-sag (NS) tungsten wire is unique in that it is a composite between two mutually insoluble metals, tungsten and potassium. The non-sag properties are attributed to longitudinal rows of sub-microscopic bubbles containing liquid and/or gaseous potassium.

The long chain of processes in a standard powder metallurgical (P/M) manufacturing of potassium-doped tungsten wire starts with the partial reduction of ammonium paratungstate tetrahydrate (APT), $(NH_4)_{10}[H_2W_{12}O_{42}].4H_2O$, in hydrogen or hydrogen/nitrogen, which produces 'tungsten blue oxide' (TBO), $xNH_3.yH_2O.WO_n$, where $0<x<0.1$, $0<y<0.2$, and $2.5<n<3.0$. The specific composition of the blue-colored TBO depends on the reduction conditions: temperature, atmosphere, type of rotary kiln or pusher-type furnace and feed rate through the furnace. Along with crystalline compounds ($WO_3$, $W_{20}O_{58}$, $W_{18}O_{49}$, $WO_2$ and hexagonal tungsten bronze phases), the industrially produced TBO powders may contain up to 50% of amorphous phases. The TBO is doped with aqueous solutions of potassium silicate (1500–2500 ppm K, 1500–2500 ppm Si) and aluminum nitrate (or alternatively aluminum chloride) (~300 ppm Al). It is then dried and milled. The doped TBO is then reduced in hydrogen to metal powder. By some manufacturers a separate "browning" (reduction to ~"$WO_1$") step is used. The doped tungsten powder is washed first with water, then with hydrofluoric and hydrochloric acid to remove unnecessary and undesired amounts of dopants. The powder is then dried in air. Appropriate powder blends are made to give a potassium content of ≧90 ppm in an acid-washed sample of powder. The washed powder is then mechanically or isostatically pressed and sintered by high-temperature resistance sintering at temperatures above 2900° C. The ingots which have a density of >17.0 g/cm$^3$ and a K content of ≧60 ppm are rolled or swaged, and finally drawn into wire.

The multi-step process leads to the outstanding high-temperature creep resistance of NS tungsten wire. It is generally recognized that the NS tungsten wire should have a potassium content of at least about 60 ppm. Furthermore, it has been proposed that a potassium content of 80 ppm or higher, and in particular 85–110 ppm K, is necessary for high performance NS tungsten wire. K. Hara, et al., *The Development of High Quality Tungsten Wire for High Stress Halogen Lamp,* Nippon Tungsten Review 29 (1997), pp. 20–29.

With the conventional multi-step process retaining potassium is a challenge. Hence, it would be an advantage to have a method which could reliably achieve the incorporation of potassium in the ranges desired for high performance NS tungsten wire.

SUMMARY OF THE INVENTION

It is an object of the invention to obviate the disadvantages of the prior art.

It is another object of the invention to increase the potassium retention of non-sag tungsten wire.

It is a further object of the invention to provide a method for reliably predicting potassium retention in NS tungsten.

In accordance with one aspect the invention, there is provided a method of making non-sag tungsten wire wherein potassium retention is increased. The method comprises the steps of:

(a) wet doping tungsten blue oxide with an aqueous solution containing potassium, silicon and aluminum and drying to form a singly doped tungsten blue oxide;

(b) dry doping the singly doped tungsten blue oxide with an amount of potassium nitrate to form a double doped tungsten blue oxide;

(c) reducing the double doped tungsten blue oxide to form a potassium-doped tungsten metal powder;

(d) acid washing the potassium-doped tungsten powder;

(e) pressing and sintering the potassium-doped tungsten metal powder to form an ingot; and (f) mechanically working the ingot to form a non-sag tungsten wire having an increased potassium retention compared to the same non-sag tungsten wire produced without the dry doping step (b).

In another aspect of the invention, step (a) further includes extracting a heteropolytungstate anion $[SiW_{11}O_{39}]^{8-}$ from a sample of the singly doped tungsten blue oxide in an aqueous salt solution and measuring the absorbance of the solution at 250 nm.

In yet another aspect of the invention, the amount of potassium nitrate added in step (b) is adjusted according to the measured absorbance of the extracted heteropolytungstate anion.

DESCRIPTION OF THE PREFERRED EMBODIMENTS

Figure 1:
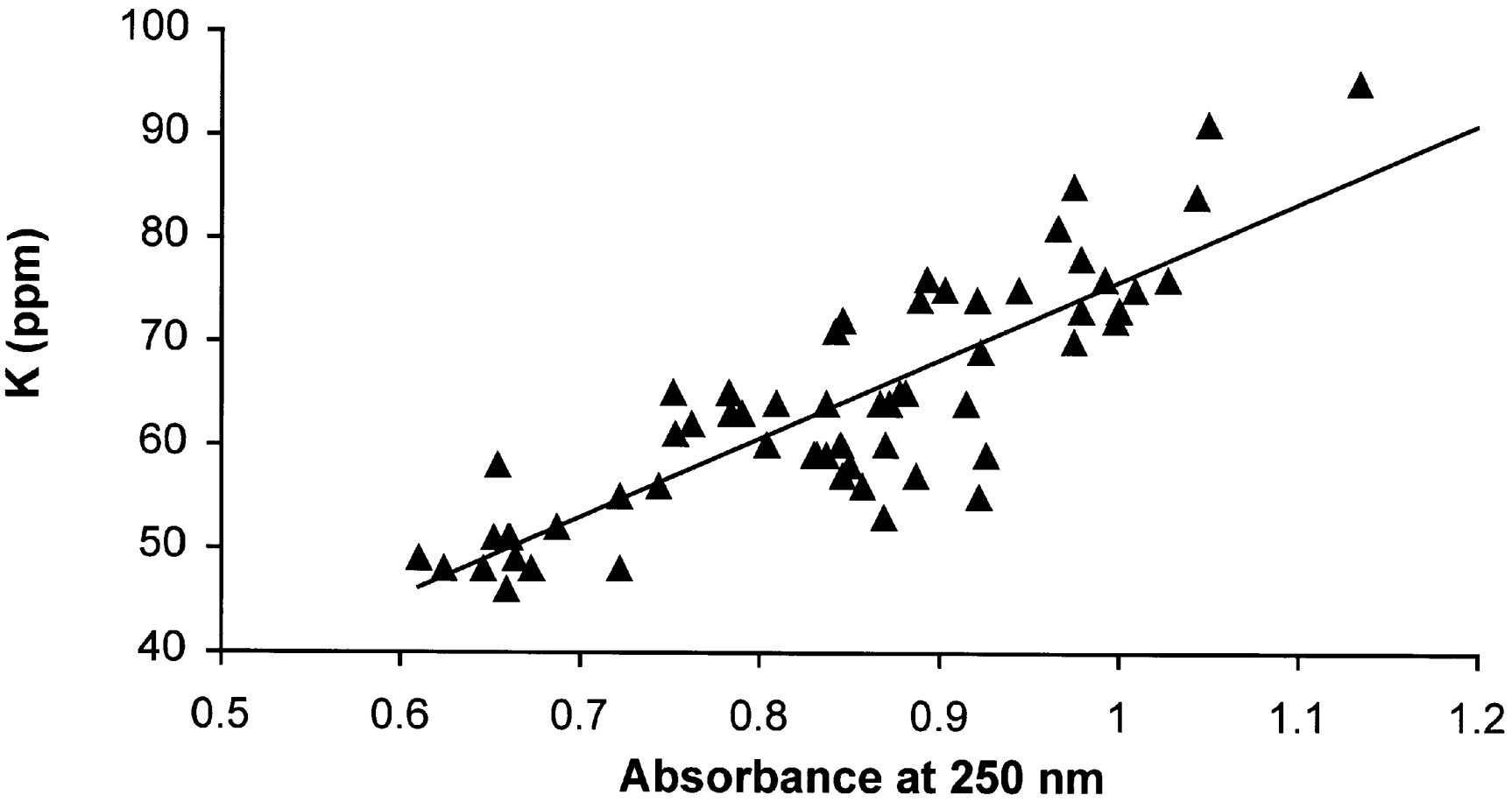
FIG. 1 shows the relationship between the potassium retention of acid washed tungsten powder and the normalized absorbance at 250 nm of the heteropolytungstate anion $[SiW_{11}O_{39}]^{8-}$ extracted from the singly doped K—Al—Si tungsten blue oxide (TBO) precursor.

For a better understanding of the present invention, together with other and further objects, advantages and capabilities thereof, reference is made to the following disclosure and appended claims taken in conjunction with the above-described drawings.

It has been discovered that potassium retention in NS tungsten processing may be improved by double doping TBO prior to reduction. The novel 'double-doping' process consists of dry doping standard singly doped K—Al—Si TBO with potassium nitrate, $KNO_3$, followed by the standard reduction, acid washing, sintering, rolling and drawing steps. Preferably, the amount of $KNO_3$ added in the dry doping step is from about 10 to about 50 grams per 10 kilograms of singly doped TBO (i.e., increasing K content by about +25% K to about +150% K). More preferably, the amount of $KNO_3$ added is about 20 grams per 10 kilograms of singly doped TBO (about +50% K). The double doping results in a distinctly higher potassium incorporation than single doped TBO. Under standard processing conditions, the method of this invention results in an increase in potassium retention of at least about 15% and generally from about 15% to about 40%. In particular, the potassium concentration in the sintered tungsten ingots was increased from 60–65 ppm K to 75–85 ppm K by double doping the TBO. The range of 75–85 ppm K is a preferred range for high performance NS tungsten wire.

Testing the starting singly doped K—Al—Si TBO before proceeding to the second doping step was essential to reliably predicting the potassium retention of each lot of material. In particular, the amount of the heteropolytungstate anion $[SiW_{11}O_{39}]^{8-}$ has been determined to be a reliable predictor of potassium retention. This species is produced during the wet K—Al—Si doping step. It is completely extractable and detectable in the near ultraviolet. The extracted anion $[SiW_{11}O_{39}]^{8-}$ is characterized by a high absorption in the near ultraviolet at 250 nm. The molar extinction coefficient for the absorption, $\epsilon_{250}$, is $3.3\times10^4$ liter/(mole·cm). A linear relationship exists between the measured absorbance at 250 nm, $A_{250}$, and the amount of potassium retained, i.e., the higher the concentration of the heteropolytungstate anion $[SiW_{11}O_{39}]^{8-}$ the higher the potassium incorporation rate of reduced tungsten powder after HF/HCl acid washing and the higher the retention rate after sintering. Assumedly, this highly-charged species with eight $K^+$ cations in its neighborhood is an ideal precursor for the incorporation of potassium during the browning step of the reduction. Since the rate of incorporation is dependent on the reduction parameters, the relationship between the heteropolytungstate anion concentration and potassium retention must be determined for each set of reduction parameters. After this relationship is determined, the absorbance of the extracted heteropolytungstate anion solution can be used to predict the potassium retention of a particular lot of singly doped K—Al—Si TBO. The amount of potassium nitrate added can be increased if the absorbance is less than 1. If the absorbance is too low, less than about 0.7, then it may not be possible to compensate for the poor performance of the singly doped TBO.

The following non-limiting examples are presented.

EXAMPLES

Singly doped K—Al—Si TBO was prepared according to the following steps. A rotary kiln was used to convert APT in a dry hydrogen flow to TBO at 550–900° C. TBO was doped in a dryer/blender with an aqueous solution containing potassium silicate, aluminum nitrate and nitric acid. After drying the blend under vacuum the singly doped TBO was hammer milled.

Heteropolytungstate anion $[SiW_{11}O_{39}]^{8-}$ was extracted from the singly doped K—Al—Si TBO with 0.05 M NaCl. In a 60 ml plastic bottle, 50 ml 0.05 M NaCl were added to a 5 g sample of the singly doped TBO and agitated on a shaker for 15 minutes at room temperature. After being allowed to settle for 2 hours, a 10 ml sample of the colorless extracted solution was diluted 1:10 with deionized water. In some cases, a 1:20 dilution was used in order to have an absorbance at 250 nm in the range of 0.6–1.2. In such a case, the measured absorbance was normalized to account for the greater dilution. The absorbance of the solution was measured on an UV-Visible Double-Beam spectrometer CINTRA 5 (GBC Scientific Equipment Pty Ltd, Australia) by using 1 cm quartz cuvettes. Two independent extractions of a singly doped TBO gave a deviation of the measured absorbance of less than 3%.

Reduction of 267 g samples of the singly doped K—Al—Si TBO were carried out in dry hydrogen in a 11"-long Inconel boat using a one-zone LINDBERG furnace under two sets of conditions: (1) ramping the furnace temperature at 6 K/min from room temperature to 900° C., a 60 minute hold at 900° C. and cooling to room temperature; (2) ramping the furnace temperature at 6 K/min from room temperature to 750° C., a 60 minute hold at 750° C., ramping at 6 K/min from 750° C. to 900° C., a 60 minute hold at 900° C. and cooling to room temperature. A 30 g sample of the homogenized tungsten powder was washed in a 250 ml plastic bottle, at first twice with 200 ml of deionized water by agitating on a shaker for 5 minutes, then with 50 ml of an aqueous solution containing 2.5 M HF and 1 M HCl by agitating on a shaker for 20 minutes. After a six-fold washing with 250 ml deionized water each time the settled powder was dried in an oven at about 80° C., homogenized and analyzed.

Figure 2:
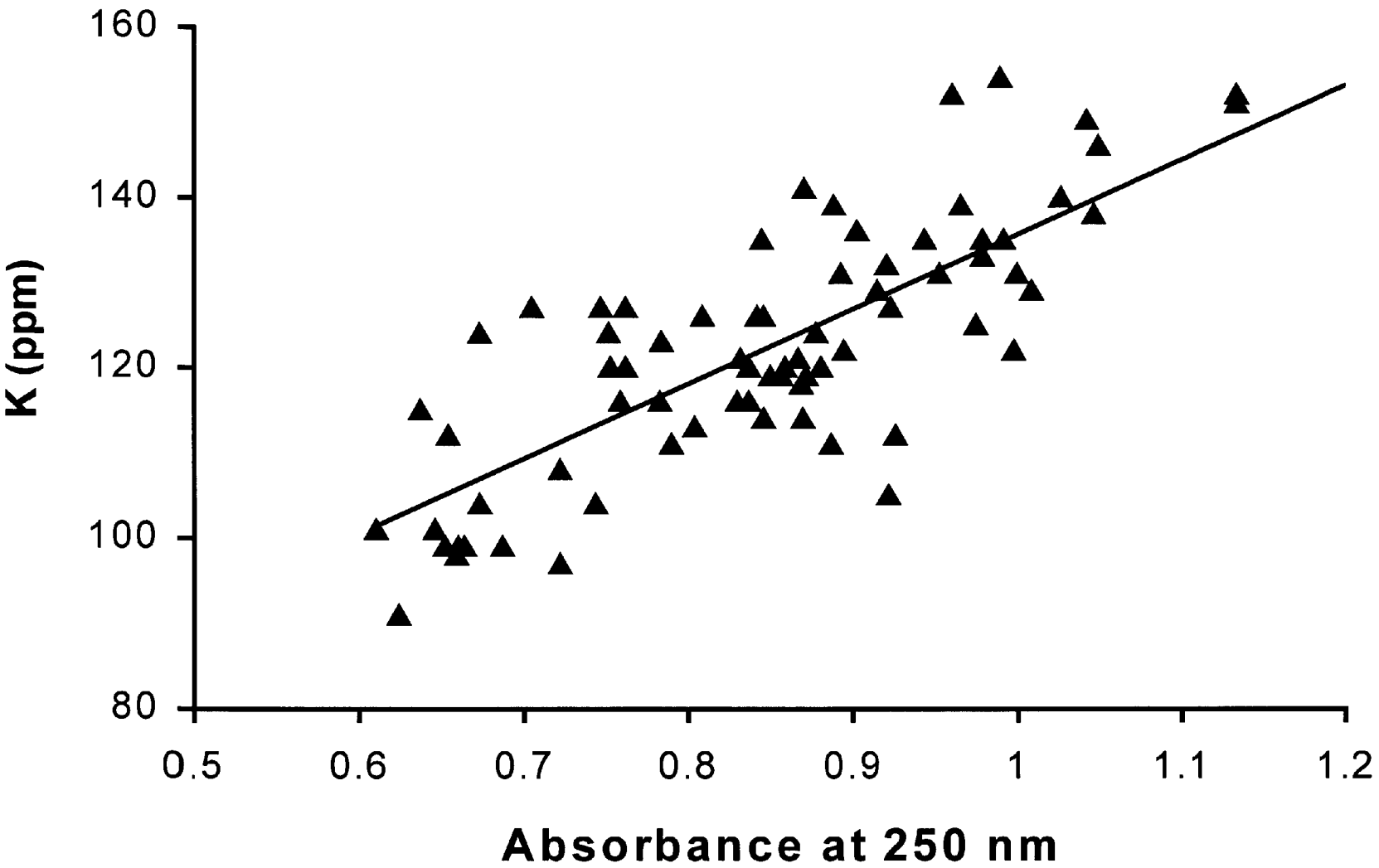
FIG. 2 shows the same relationship under a different set of reduction conditions.

FIG. 1 is a graph of the amount of incorporated potassium in the acid washed tungsten powder made using reduction condition (1) as a function of the normalized absorbance, $A_{250}$, of the extracted anion. FIG. 2 is a graph of the amount of incorporated potassium in the acid washed tungsten powder made using reduction condition (2) as a function of the normalized absorbance, $A_{250}$, of the extracted anion. For reduction condition (1), the relationship between the potassium content of the acid washed tungsten and the absorbance at 250 nm is $K(ppm)=75.855\cdot A_{250}$. For reduction condition (2), the corresponding relationship is $K(ppm)=96.57\cdot A_{250}+40.537$. These relationships were determined by testing 60 individual singly doped TBO lots under reduction condition (1) and 74 lots under reduction condition (2).

Table 1 summarizes the results for three materials used to make double doped TBOs. The prediction of potassium incorporation after acid washing of reduced powders is made by using the previously determined relationships. In each case, the calculated potassium retention (calc.) compares favorably with the measured potassium concentration (exp.). As later presented data will show, an absorbance at 250 nm of at least about 1 is necessary to obtain NS tungsten containing 75–85 ppm K. Lots A and C exhibit an absorbance which predict this favorable result. Lot B has a low absorbance which predicts an unfavorable result.

TABLE 1

| Reduction of singly doped K—A—Si TBO | | | | | |
|---|---|---|---|---|---|
| | Absorbance of | Potassium (ppm) of acid washed tungsten powder | | | |
| | Extracted Solution | Reduction Condition (1) | | Reduction Condition (2) | |
| Lot | at 250 nm | Calc. | Exp. | Calc. | Exp. |
| A | 1.12 | 85 | 95 | 146 | 152 |
| B | 0.66 | 50 | 51 | 106 | 103 |
| C | 0.99 | 75 | 85 | 135 | 154 |

Thirty kilograms of the singly doped K—Al—Si TBO, lot A, was blended with an amount of ground potassium nitrate, $KNO_3$, which increased its potassium content by 55% (19.5 g $KNO_3$ per 10 kg of lot A). The 'double-doped' material designated AKN (+55% K) was reduced using standard manufacturing conditions. Twenty-four kilogram portions of the reduced powder were washed in a 55 liter plastic barrel using at first 50 liters of deionized water, then 40 liters of a HF/HCl mixture made from 5.6 liters of HF (49%), 3.3 liters of HCl (37%) and 11.1 liters of deionized water. After a six-fold washing with 50 liters of deionized water each the powders were dried at about 80° C. and sieved through a 250 mesh sieve.

Lots of double doped BKN and CKN were produced by the same general procedure as lot AKN. The double doped BKN was made with +110% K rather than +55% K. In the case of CKN, two different reduction conditions for the final reduction step were used:

i) CKN-450: Standard reduction with 450 g boatload and final-reduction-3-heating-zone conditions (1450–1550–1650° F.) and a hydrogen flow of 360 cfh.

ii) CKN-600: Standard reduction with 600 g boatload and final-reduction-3-heating-zone (1450–1550–1650° F.) conditions and a hydrogen flow of 360 cfh.

Six kilogram ingots were resistance sintered from mechanically pressed double doped tungsten powders. Two different resistance sintering schedules were used: (I) ramping to about 1800° C., holding for 1 to 8 minutes, ramping to about 2400° C., holding for 1 to 10 minutes, ramping to about 2800° C. and holding for 30 to 60 minutes; (II) same as schedule (I) except lower first and second holding temperatures were used, about 1750° C. and about 2120° C., respectively. Data from the analysis of the ingots is given in Table 2.

TABLE 2

| Characterization of sintered ingots | | | | | | | |
|---|---|---|---|---|---|---|---|
| | Starting powder | | Sintered ingot | | | | |
| | | | | | | Potassium (ppm) | |
| Lot | K (ppm) | FSSS (μm) | Ingot No. | Sintering Schedule | Density (g/cm³) | Edge | Center |
| AKN-450 | 117 | 3.9 | 1 | I | 17.16 | 80 | 73 |
| | | | 2 | II | 16.95 | 82 | 79 |
| BKN-450 | 94 | 4.0 | 3 | II | 17.18 | 66 | 63 |
| CKN-450 | 117 | 3.1 | 4 | II | 17.03 | 83 | 72 |
| CKN-600 | 99 | 3.6 | 5 | II | 17.29 | 75 | 70 |

Sintering schedule (II) provided an increase of about 5 ppm K with little or no decrease in density. Ingots (1), (2), (4) and (5) which were made from lots AKN and CKN have potassium concentrations in the preferred range for high performance NS tungsten, about 75 to about 85 ppm K. Ingot (3) made from lot BKN had a substantially lower potassium content. This behavior was predicted from low absorbance of solution containing the extracted heteropolytungstate anion (Table 1). Even increasing the amount of potassium nitrate was unable to raise the potassium level into the preferred range for high performance NS tungsten.

The tensile strengths of 5.66-mg NS tungsten wire drawn from ingots (1), (2) and (4) are very comparable to other high performance NS tungsten wires. The 5.66-mg wire drawn from ingots (1) and (2) were made into filaments and tested 50 W/120V halogen lamps. The sag performance after 300 hours was considerably better than for standard NS tungsten wire filaments.

While there has been shown and described what are at the present considered the preferred embodiments of the invention, it will be obvious to those skilled in the art that various changes and modifications may be made therein without departing from the scope of the invention as defined by the appended claims.

We claim:

1. A method of making non-sag tungsten wire comprising the steps of:

(a) wet doping tungsten blue oxide with an aqueous solution containing potassium, silicon and aluminum and drying to form a singly doped tungsten blue oxide;

(b) dry doping the singly doped tungsten blue oxide with an amount of potassium nitrate to form a double doped tungsten blue oxide;

(c) reducing the double doped tungsten blue oxide to form a potassium-doped tungsten metal powder;

(d) acid washing the potassium-doped tungsten powder;

(e) pressing and sintering the potassium-doped tungsten metal powder to form an ingot; and (f) mechanically working the ingot to form a non-sag tungsten wire having an increased potassium retention compared to the same non-sag tungsten wire produced without the dry doping step (b).

2. The method of claim 1 wherein the amount of potassium nitrate added in the dry doping step (b) results in the double doped tungsten blue oxide having from about 25% to about 150% more potassium than the singly doped tungsten blue oxide.

3. The method of claim 1 wherein the amount of potassium nitrate added in the dry doping step (b) results in the double doped tungsten blue oxide having about 50% more potassium than the singly doped tungsten blue oxide.

4. The method of claim 1 wherein step (a) further includes extracting a heteropolytungstate anion $[SiW_{11}O_{39}]^{8-}$ from a sample of the singly doped tungsten blue oxide in an aqueous salt solution and measuring the absorbance of the solution at 250 nm and wherein the amount of potassium nitrate added in step (b) is adjusted according to the measured absorbance.

5. The method of claim 4 wherein the measured absorbance is at least about 1.

6. The method of claim 1 wherein the potassium retention is increased at least about 15%.

7. The method of claim 1 wherein the potassium retention is increased from about 15% to about 40%.

8. A method of making potassium-doped tungsten metal comprising the steps of:

(a) wet doping tungsten blue oxide with an aqueous solution containing potassium, silicon and aluminum and drying to form a singly doped tungsten blue oxide;

(b) dry doping the singly doped tungsten blue oxide with an amount of potassium nitrate to form a double doped tungsten blue oxide; and (c) reducing the double doped tungsten blue oxide to form a potassium-doped tungsten metal powder.

9. The method of claim 8 wherein step (a) further includes extracting a heteropolytungstate anion $[SiW_{11}O_{39}]^{8-}$ from a sample of the singly doped tungsten blue oxide in an aqueous salt solution and measuring the absorbance of the solution at 250 nm and wherein the amount of potassium nitrate added in step (b) is adjusted according to the measured absorbance.

10. The method of claim 9 wherein the measured absorbance is at least about 1.

* * * * *